US008254621B2

(12) United States Patent
Silvestri et al.

(10) Patent No.: US 8,254,621 B2
(45) Date of Patent: Aug. 28, 2012

(54) EARPIECE POSITIONING AND RETAINING

(75) Inventors: Ryan C. Silvestri, Franklin, MA (US); Eric M. Wallace, Chelmsford, MA (US); Kevin P. Annunziato, Medway, MA (US); Ian M. Collier, Cambridge, MA (US); Michael Monahan, Southborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/413,987

(22) Filed: Mar. 7, 2012

(65) Prior Publication Data

US 2012/0163617 A1 Jun. 28, 2012

Related U.S. Application Data

(63) Continuation of application No. 12/860,531, filed on Aug. 20, 2010.

(60) Provisional application No. 61/374,107, filed on Aug. 16, 2010.

(51) Int. Cl.
*H04R 25/00* (2006.01)

(52) U.S. Cl. ..... 381/380; 381/370; 381/374

(58) Field of Classification Search ..... 381/315, 381/370–371, 374, 379–384
See application file for complete search history.

(56) References Cited

U.S. PATENT DOCUMENTS 588,099 A 8/1897 Blount
931,768 A 8/1909 Kirkpatrick
1,564,474 A 12/1925 Fensky
1,614,987 A 1/1927 Langbeck et al.
1,668,890 A 5/1928 Curran et al.
1,688,910 A 10/1928 Winship
1,753,817 A 4/1930 Aber
1,893,143 A 1/1933 Koch
1,969,559 A 8/1934 Kelly
2,437,490 A 3/1948 Watson
2,521,414 A 9/1950 Schier
2,545,731 A 3/1951 French
2,763,334 A 9/1956 Starkey
2,908,343 A 10/1959 Hummert
3,053,061 A 9/1962 French
3,157,245 A 11/1964 Bernstein
D221,442 S 8/1971 Feingold
4,010,820 A 3/1977 Johnson
4,055,233 A 10/1977 Huntress (Continued)

FOREIGN PATENT DOCUMENTS

DE 29718483 U1 2/1999

(Continued)

OTHER PUBLICATIONS

International Search Report and Written Opinion dated Oct. 27, 2011 for International application No. PCT/US2011/048233.

*Primary Examiner* — Suhan Ni

(57) ABSTRACT

A positioning and retaining structure for an in-ear earpiece. An outer leg and an inner leg are attached to each other at an attachment end and attached to a body of the earpiece at the other end. The outer leg lies in a plane. The positioning and retaining structure have a stiffness that is greater when force is applied to the attachment end in a counterclockwise direction in the plane of the outer leg than when force is applied to the attachment end in a clockwise direction in the plane of the outer leg. The positioning and retaining structure position an earpiece associated with the earpiece in a users ear and retains the earpiece in its position.

11 Claims, 10 Drawing Sheets

U.S. PATENT DOCUMENTS 4,219,018 A 8/1980 Draper, Jr.
D266,590 S 10/1982 Bennett
4,353,364 A 10/1982 Woods
D274,814 S 7/1984 Tang
4,540,063 A 9/1985 Ochi et al.
4,646,872 A 3/1987 Kamon et al.
4,896,679 A 1/1990 St. Pierre
D316,550 S 4/1991 Sogabe
D318,670 S 7/1991 Taniguchi
5,055,233 A 10/1991 Borland et al.
D326,655 S 6/1992 Iribe
5,222,151 A 6/1993 Nagayoshi et al.
5,548,643 A 8/1996 Dalgleish et al.
5,625,171 A 4/1997 Marshall
5,654,530 A 8/1997 Sauer et al.
5,668,354 A 9/1997 Falco
D388,093 S 12/1997 Frengley
5,712,453 A 1/1998 Bungardt et al.
5,727,566 A 3/1998 Leight
5,957,136 A 9/1999 Magidson et al.
D430,139 S 8/2000 Peters et al.
D430,547 S 9/2000 Yoon
D430,860 S 9/2000 Yoon
6,129,175 A 10/2000 Tutor et al.
6,241,041 B1 6/2001 Leight
6,449,374 B1 9/2002 Skulley et al.
D469,755 S 2/2003 Hlas et al.
D470,122 S 2/2003 Hlas et al.
D470,123 S 2/2003 Hlas et al.
D470,128 S 2/2003 Hlas et al.
D470,129 S 2/2003 Hlas et al.
D471,537 S 3/2003 Ham
D471,890 S 3/2003 Clarkson
D473,204 S 4/2003 Tanio
D478,991 S 8/2003 Dyer et al.
6,690,807 B1 2/2004 Meyer
6,795,718 B2 9/2004 Bae
6,819,762 B2 11/2004 Jones et al.
6,820,717 B2 11/2004 Fleming et al.
6,868,284 B2 3/2005 Bae
6,879,697 B2 4/2005 Tøpholm
D505,132 S 5/2005 Linville et al.
6,944,307 B2 9/2005 Berg
D510,574 S 10/2005 Okada
6,961,440 B1 11/2005 Schlaegel
7,050,599 B2 5/2006 Baskerville
7,068,803 B2 6/2006 Kuhlmann et al.
D525,962 S 8/2006 Elson
D538,271 S 3/2007 Kim et al.
7,233,676 B2 6/2007 Bayer
D558,735 S 1/2008 Carr et al.
7,340,075 B2 3/2008 Bayer
D566,099 S 4/2008 Komiyama
D566,691 S 4/2008 Andre et al.
D568,302 S 5/2008 Oh
D569,841 S 5/2008 Chung et al.
7,394,910 B2 7/2008 Smith et al.
D575,277 S 8/2008 Gaarde et al.
D575,772 S 8/2008 Schultz et al.
7,412,068 B2 8/2008 Bayer
D578,507 S 10/2008 Ando
D578,508 S 10/2008 Wang
D579,006 S 10/2008 Kim et al.
D582,389 S 12/2008 Bose et al.
D582,397 S 12/2008 Christopher
D582,398 S 12/2008 Nam et al.
D582,889 S 12/2008 Bose et al.
D584,284 S 1/2009 Carr et al.
D584,294 S 1/2009 Nam et al.
D585,881 S 2/2009 Nam et al.
D588,099 S 3/2009 Yuyama
D589,945 S 4/2009 Esses
7,536,008 B2 5/2009 Howes et al.
D596,164 S 7/2009 Henning
D601,134 S 9/2009 Elabidi et al.
D602,476 S 10/2009 Lee et al.
D605,170 S 12/2009 Keinanen
D605,628 S 12/2009 Ando
D607,875 S 1/2010 Pedersen, II
D618,219 S 6/2010 Burgett et al.
D618,221 S 6/2010 Fahrendorff et al.
D620,927 S 8/2010 Li
D621,817 S 8/2010 Brickstad
D622,265 S 8/2010 Rye
D622,704 S 8/2010 Fahrendorff et al.
7,778,410 B2 8/2010 Liu et al.
D628,188 S 11/2010 Koch
D633,481 S 3/2011 Chen
D634,305 S 3/2011 Hoggarth
7,949,127 B2 5/2011 Pedersen et al.
D640,670 S 6/2011 Rye
7,965,855 B1 6/2011 Ham
D641,008 S 7/2011 Lee et al.
D641,747 S 7/2011 Gisborne
D645,458 S 9/2011 Silvestri et al.
2002/0096391 A1 7/2002 Smith et al.
2002/0172386 A1 11/2002 Bayer
2003/0091210 A1 5/2003 Baskerville
2004/0045558 A1 3/2004 Taylor et al.
2004/0163653 A1 8/2004 Fleming
2006/0067556 A1 3/2006 Bailey et al.
2006/0177080 A1 8/2006 Smith
2006/0188122 A1 8/2006 Smith
2006/0215864 A1 9/2006 Espersen et al.
2007/0116309 A1 5/2007 Smith
2007/0183615 A1 8/2007 Wurfel
2007/0254725 A1 11/2007 Smith
2008/0085030 A1 4/2008 Smith
2008/0159577 A1 7/2008 Smith
2008/0181441 A1 7/2008 Smith
2008/0247561 A1 10/2008 Smith
2009/0092269 A1 4/2009 Nielsen et al.
2009/0141923 A1 6/2009 Smith
2009/0180654 A1 7/2009 Nielsen
2009/0226025 A1 9/2009 Howes et al.
2009/0323993 A1 12/2009 Slemming et al.
2010/0278364 A1 11/2010 Berg

FOREIGN PATENT DOCUMENTS

DE 202011002165 U1 5/2011
EP 368125 A2 5/1990
EP 786241 B1 7/1997
EP 1377113 A2 1/2004
EP 1594340 A1 11/2005
JP 2001333484 A 11/2001
JP 2005184579 A 7/2005
WO 0150813 A2 7/2001
WO 0150993 A1 7/2001
WO 2006104981 A2 10/2006
WO 2009030229 A1 3/2009
WO 2010-031775 A1 3/2010
WO 2010-040350 A1 4/2010
WO 2010040351 A1 4/2010

EARPIECE POSITIONING AND RETAINING

CROSS REFERENCE TO RELATED APPLICATIONS

This application is a continuation of U.S. pat. app. Ser. No. 12/860,531, filed Aug. 20, 2010, by Silvestri, et al., which is a continuation-in-part of U.S. Provisional Pat. App. 61/374,107, filed Aug. 16, 2010 by Silvestri, et al. This application claims priority to both app. Ser. Nos. 12/860,531 and 61/374,107, and both are incorporated herein in their entirety.

BACKGROUND

This specification describes a positioning and retaining structure for an earpiece.

SUMMARY

In one aspect, an earpiece, includes an electronics module for wirelessly receiving incoming audio signals from an external source. The electronics module includes a microphone for transducing sound into outgoing audio signals. The electronics module further includes circuitry for wirelessly transmitting the outgoing audio signals;. The earpiece further includes an audio module includes an acoustic driver for transducing the received audio signals to acoustic energy. The earpiece further includes an in-ear portion. The in-ear portion includes a body. The body includes an outlet section dimensioned and arranged to fit inside a user's ear canal entrance, a passageway for conducting the acoustic energy from the audio module to an opening in the outlet section, and a positioning and retaining structure. The positioning and retaining structure includes at least an outer leg and an inner leg. Each of the outer leg and inner leg are attached at an attachment end to the body and attached at a joined end to each other. The outer leg lies in a plane. The positioning and retaining structure is substantially stiffer when force is applied to the end in one rotational direction in the plane of the outer leg than when it applied in the opposite rotational direction in the plane of the outer leg. In its intended position, one of the two legs contacts the anti-helix at the rear of the concha; the joined end is under the anti-helix, a planar portion of the body contacts the concha, and a portion of the body is under the anti-tragus. The plane of the outer leg may be slanted relative to the body plane. When the earpiece is inserted into the ear and the body is rotated in a clockwise direction, one of (1) the joined end contacting the base of the helix or (2) the joined end becoming wedged in the cymba concha region of the anti-helix, or (3) the inner leg contacting the base of the helix, may prevent further clockwise rotation. When the earpiece is in position, a reaction force may be exerted that urges the outer leg against the anti-helix at the rear of the concha. The body may include an outlet section and an inner section and the inner section may include a harder material than the outlet section. The outlet section may include a material of hardness of about 16 Shore A and the inner section nmayh include a material of about 70 shore A. The acoustic module may include a nozzle for directing sound waves to the outlet section. The nozzle may be characterized by an outer diameter measured in a direction. The the outlet section may be characterized by a diameter measured in the direction. The outer diameter of the nozzle may be less than the inner diameter of the outlet section. The outlet section and the nozzle may be generally oval. The minor axis of the outlet section may be about 4.80 mm and the minor axis of the nozzle may be about 4.05 mm. The audio module may be oriented so that a portion of the audio module is in the concha of the ear of a user when the earpiece is in position. The stiffness when force is applied in a direction perpendicular to the plane may be less than 0.01 N/mm.

In another aspect, an earpiece, includes an electronics module for wirelessly receiving incoming audio signals from an external source. The electronics module includes a microphone for transducing sound into outgoing audio signals. The electronics module further includes circuitry for wirelessly transmitting the outgoing audio signals. The earpiece further includes an audio module that includes an acoustic driver for transducing the received audio signals to acoustic energy. The earpiece further includes an in-ear portion. The in-ear portion includes a body that includes an ear canal section dimensioned and arranged to fit inside a user's ear canal and a passageway for conducting the acoustic energy from the audio module to the user's ear canal. The outer leg may lie in a plane. The positioning and retaining structure may be substantially stiffer when force is applied to the end in one rotational direction in the plane of the outer leg than when it applied in the opposite rotational direction in the plane of the outer leg. The stiffness when force is applied in a direction perpendicular to the plane of the outer leg may be less than the stiffness when force is applied in either the clockwise or counterclockwise directions in the plane of the outer leg. The stiffness when force is applied in a direction perpendicular to the plane of the outer leg may be less than 0.8 of the stiffness when force is applied in either the clockwise or counterclockwise directions in the plane of the outer leg. The stiffness when force is applied in a direction perpendicular to the plane of the outer leg may be less than 0.01 N/mm.

In another aspect, an earpiece, includes an electronics module for wirelessly receiving incoming audio signals from an external source. The electronics module includes a microphone for transducing sound into outgoing audio signals. The electronics module further includes circuitry for wirelessly transmitting the outgoing audio signals. The earpiece further includes an audio module that includes an acoustic driver for transducing the received audio signals to acoustic energy. The earpiece further includes an in-ear portion that includes a body. The body includes an outlet section dimensioned and arranged to fit inside the ear canal of a user, a passageway for conducting the acoustic energy from the audio module to an opening in the outlet section, and a positioning structure that includes an inner leg and an outer leg, The inner leg and the outer leg are attached at an attachment end to the body and attached at a joined end to each other. The positioning structure provides at least three modes for preventing clockwise rotation past a rotational position of the earpiece. The modes include the tip contacting the base of the helix, the tip becoming wedged under the anti-helix in the cymba concha region, and the inner leg contacting the base of the helix. The earpiece may further include a retaining structure. Theretaining structure may include an inner leg and an outer leg. The inner leg and the outer leg may be attached at an attachment end to the body and attached at a joined end to each other. With the earpiece in its intended position, the outer leg may be urged against the anti-helix at the rear of the concha and at least one of (1) the tip may be under the anti-helix or (2) a portion of at least one of the body and the outer leg may be under the anti-tragus or (3) the body may engage the ear canal.

In another aspect, an earpiece, includes an electronics module for wirelessly receiving incoming audio signals from an external source. The electronics module includes a microphone for transducing sound into outgoing audio signals. The electronics module further includes circuitry for wirelessly transmitting the outgoing audio signals. The earpiece further includes an audio module that includes an acoustic driver for transducing the received audio signals to acoustic energy. The earpiece further includes a body including an outlet section dimensioned and arranged to fit inside the ear canal of a user. That body further includes a passageway for conducting the acoustic energy from the audio module to an opening in the outlet section. The body further includes a retaining structure includes an inner leg and an outer leg. The inner leg and the outer leg may be attached at an attachment end to the body and attached at a joined end to each other. With the earpiece in its intended position, the outer leg is urged against the anti-helix at the rear of the concha, the body engages the ear canal and at least one of (1) the tip is under the anti-helix; (2) a portion of at least one of the body and the outer leg is under the anti-tragus.

In another aspect, a positioning and retaining structure for an in-ear earpiece includes an outer leg and an inner leg attached to each other at an attachment end and attached to a body of the earpiece at the other end. The outer leg lies in a plane. The positioning and retaining structure has a stiffness that is greater when force is applied to the attachment end in a counterclockwise direction in the plane of the outer leg than when force is applied to the attachment end in a clockwise direction in the plane of the outer leg. The stiffness when force is applied in a counterclockwise direction may be more than three times the stiffness when force is applied in a clockwise direction. The stiffness when force is applied in a direction perpendicular to the plane of the outer leg may be less than when a force is applied in either the clockwise or counterclockwise direction in the plane of the outer leg. The stiffness when force is applied in a direction perpendicular to the plane of the outer leg may be less than 0.8 of the stiffness when force is applied in either the clockwise or counterclockwise directions in the plane of the outer leg. The stiffness when force is applied in a direction perpendicular to the plane of the outer leg may be less than 0.01 N/mm.

In another aspect, a positioning structure for an in-ear earpiece includes a first leg and a second leg attached to each other at an attachment end to form a tip and attached to a body of the earpiece at the other end. The positioning structure provides at least three modes for preventing clockwise rotation of the earpiece past a rotational position. The modes include the tip contacting the base of the helix; the tip becoming wedged under the anti-helix in the cymba concha region; and the inner leg contacting the base of the helix.

In another aspect, a retaining structure of an in-ear earpiece, includes an inner leg and an outer leg. The inner leg and the outer leg are attached at an attachment end to the body and attached at a joined end to each other. With the earpiece in its intended position, the outer leg is urged against the anti-helix at the rear of the concha, the body engages the ear canal; and at least one of (1) the tip is under the anti-helix; or (2) a portion of at least one of the body and the outer leg are under the anti-tragus.

In another aspect, a positioning and retaining structure for an in-ear earpiece, includes an inner leg and an outer leg attached at attachment end to each other and at a second end to an earpiece body. The inner leg and outer leg are arranged to provide at least three modes for preventing clockwise rotation of the earpieces. The modes include the tip contacting the base of the helix, the tip becoming wedged under the anti-helix, and the inner leg contacting the base of the helix. The inner leg and the outer leg are further arranged so that with the earpiece in its intended position, the outer leg is urged against the anti-helix at the rear of the concha, the body engages the ear canal; and at least one of (1) the tip is under the anti-helix; or (2) a portion of at least one of the body and the outer leg are under the anti-tragus.

Other features, objects, and advantages will become apparent from the following detailed description, when read in connection with the following drawing, in which:

DETAILED DESCRIPTION

Figure 1:
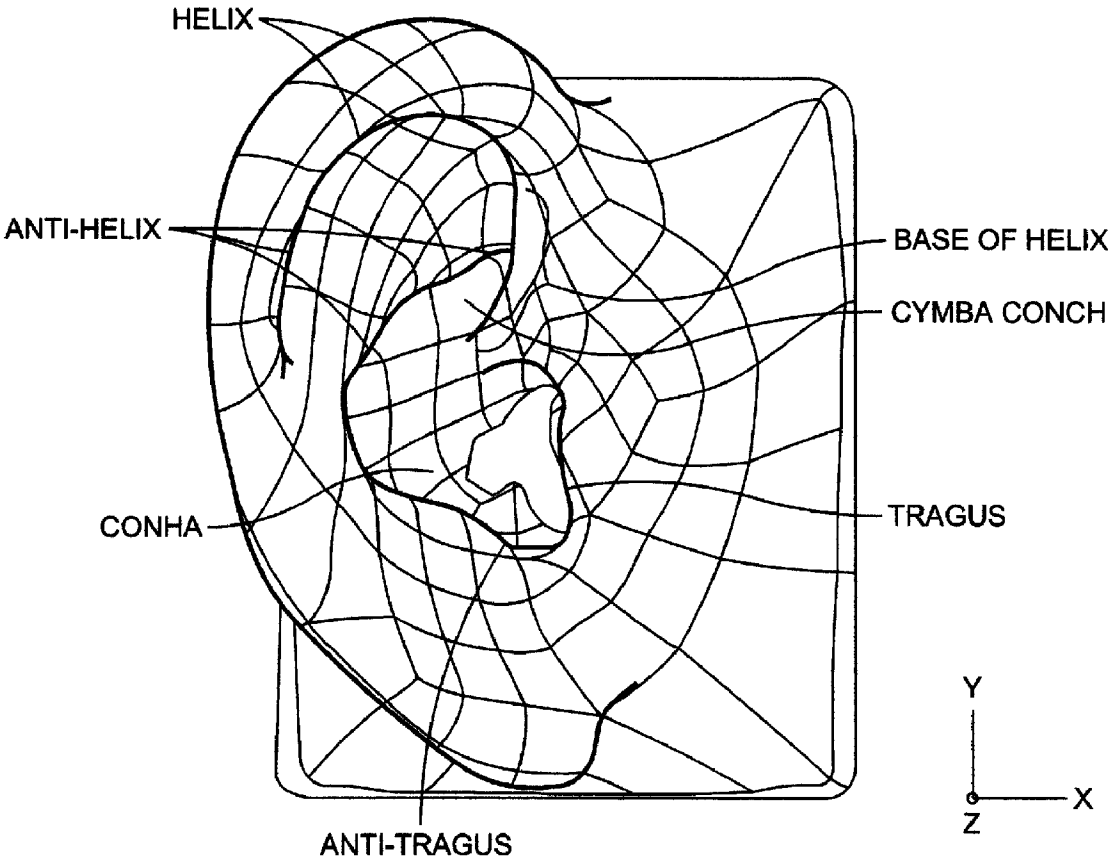
FIG. 1 is a side view of a human ear.

FIG. 1 shows the human ear and a Cartesian coordinate system, for the purpose of identifying terminology used in this application. In the description that follows, "forward" or "front " will refer to the + direction along the X-axis, "backward" or "rear" will refer to the – direction along the X-axis; "above" or "up" will refer to the + direction along the Y-axis, "below" or "down" will refer to the – direction along the Y-axis; "on top of" and "outward" will refer to the + direction along the Z-axis (out of the page), and "behind" or "under" or "inward" will refer to the – direction along the Z-axis (into the page).

The description that follows will be for an earpiece that fits in the right ear. For an earpiece that fits in the left ear, some of the definitions, or the "+" and "–" directions may be reversed, and "clockwise" and "counterclockwise" may mean rotation in different directions relative to the ear or other elements than is meant in the description below. There are many different ear sizes and geometries. Some ears have additional features that are not shown in FIG. 1. Some ears lack some of the features that are shown in FIG. 1. Some features may be more or less prominent than are shown in FIG. 1.

Figure 2:
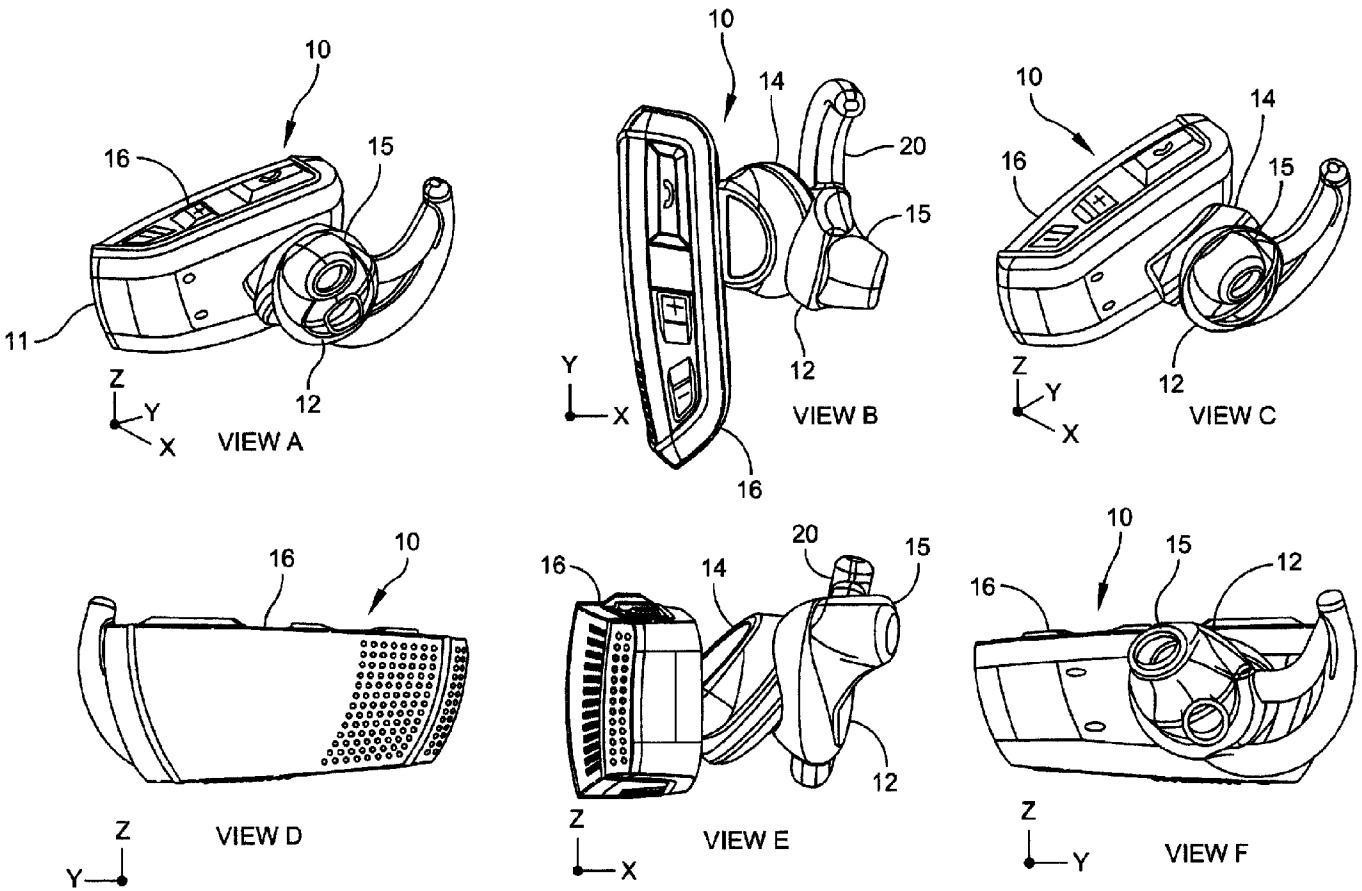
FIG. 2 shows several views of an earpiece.

FIG. 2 shows several views of an in-ear earpiece 10. The earpiece 10 includes a body 12, an acoustic driver module 14, which may be mechanically coupled to an optional electronics module 16. The body 12 may have an outlet section 15 that fits into the ear canal. Other reference numbers will be identified below. The earpiece may be wireless, that is, there may be no wire or cable that mechanically or electronically couples the earpiece to any other device. Some elements of earpiece 10 may not be visible in some views.

The optional electronics module 16 may include a microphone at one end 11 of the electronics module 16. The optional electronics module 16 may also include electronic circuitry to wirelessly receive radiated electronic signals; electronic circuitry to transmit audio signals to, and to control the operation of, the acoustic driver; a battery; and other circuitry. The electronics module may be enclosed in a substantially box-shaped housing with planar walls.

It is desirable to place the in-ear earpiece 10 in the ear so that it is oriented properly, so that it is stable (that is, it remains in the ear), and so that it is comfortable. Proper orientation may include positioning the body so that the electronics module, if present, is oriented so that the microphone is pointed toward the mouth of the user and so that a planar surface of the electronics module 16 is positioned near or against the side of the head of the user to prevent excessive motion of the earpiece. An electronics module 16, if present, and the possible wireless characteristic of the earpiece makes the orientation and stability of the earpiece more complicated than in earpieces that have wires or cables and that do not have the electronics module. The wires tend to orient the earpiece so that the wire or cable hangs down, so the absence of the wire or cable makes proper orientation more difficult to achieve. If the electronics module is not present, proper orientation could include orienting the body so that the outlet section 15 is oriented properly relative to the ear canal. The electronics module 16 tends to be heavy relative to other components of the earpiece so that it tends to shift the center of mass outward, where there is no contact between the earpiece and the head of the user, so that the earpiece tends to move downward along the Y-axis and to rotate about the Z-axis and the X-axis.

Figure 3:
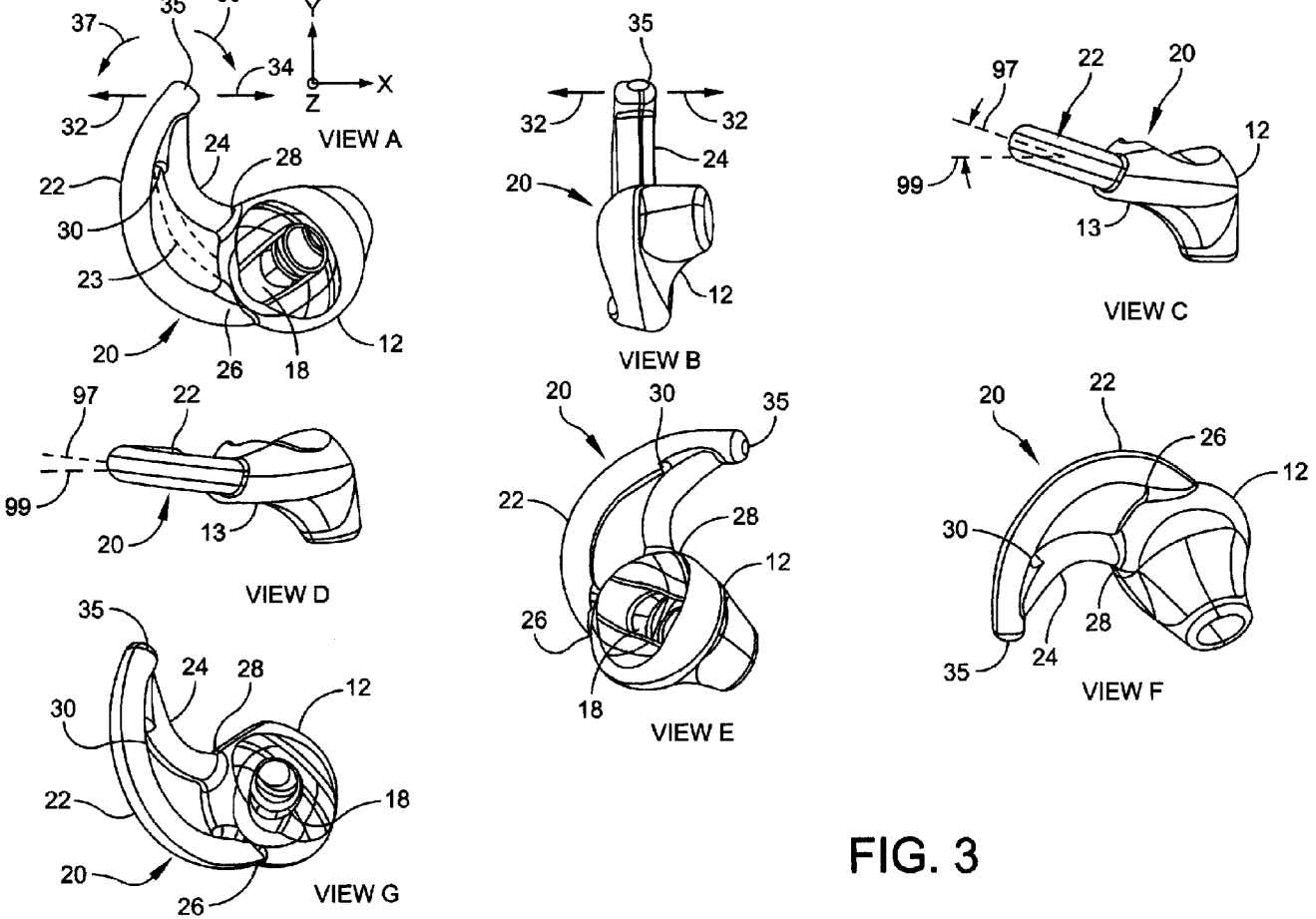
FIG. 3 shows several view of a portion of the earpiece.

FIG. 3 shows a cutout view of the body 12. The body 12 includes a passageway 18 to conduct sound waves radiated by the acoustic driver in the acoustic driver module to the ear canal. The body 12 that has a substantially planar surface 13 that substantially rests against, the concha at one end. Extending from the body 12 is a positioning and retaining structure 20 that, together with the body 12 holds the earpiece in position without the use of ear hooks, or so-called "click lock" tips, which may be unstable (tending to fall out of the ear), uncomfortable (because they press against the ear), or ill fitting (because they do not conform to the ear). The positioning and retaining structure 20 includes at least an outer leg 22 and an inner leg 24 that extend from the body. Other implementations may have additional legs such as leg 23, shown in dotted lines. Each of the two legs is connected to the body at one end 26 and 28 respectively. The outer leg is curved to generally follow the curve of the anti-helix at the rear of the concha. The second ends of each of the legs are joined at point 30. The joined inner and outer legs may extend past point 30 to a positioning and retaining structure extremity 35. In one implementation, the positioning and retaining structure 20 is made of silicone, with a 16 Shore A durometer. The outer leg 22 lies in a plane.

The positioning and retaining structure is substantially stiffer (less compliant) when force is applied to the extremity 35 in the counterclockwise direction as indicated by arrow 37 (about the Z-axis) than when force is applied to the extremity 35 in the clockwise direction as indicated by arrow 39 about the Z-axis. The difference in compliance can be attained by the geometry of the two legs 22 and 24, the material of two legs 22 and 24, and by prestressing one or both of the legs 22 and 24, or a combination of geometry, material, and prestressing. The compliance may further be controlled by adding more legs to the legs 22 and 24. The positioning and retaining structure is substantially more compliant when force is applied to the extremity along the Z-axis, indicated by arrow 33 than when force is applied about the Z-axis, indicated by arrows 37 and 39.

In one measurement, the stiffness when force is applied the counterclockwise direction (indicated by arrow 37) was approximated by holding the body 12 stationary, applying a force to the extremity 35 along the X-axis in the −X direction, and measuring the displacement in the −X direction; the stiffness when force is applied in the clockwise direction (indicated by arrow 39) was approximated by holding the body 12 stationary and pulling the extremity 35 along the Y-axis in the −Y direction. The stiffness in the counterclockwise direction ranged from 0.03 N/mm (Newtons per millimeter) to 0.06 N/mm, depending on the size of the body 12 and of the positioning and retaining structure 20. The stiffness in the clockwise direction ranged from 0.010 N/mm to 0.016 N/mm, also dependent on the size of the body 12 and of the positioning and retaining structure 20. For equivalent sized bodies and positioning and retaining structures, the stiffness in the counterclockwise direction ranged from 3.0× to 4.3× the stiffness in the clockwise direction. In one measurement, force was applied along the Z-axis. The stiffness ranged from 0.005 N/mm to 0.008 N/mm, dependent on the size of the body 12 and of the positioning and retaining structure 20; a typical range of stiffnesses might be 0.001 N/mm to 0.01 N/mm. For equivalent sized bodies and positioning and retaining structures, the stiffness when force was applied along the Z-axis ranged from 0.43 to 0.80 of the stiffness when force was applied in the counterclockwise direction.

Figure 4:
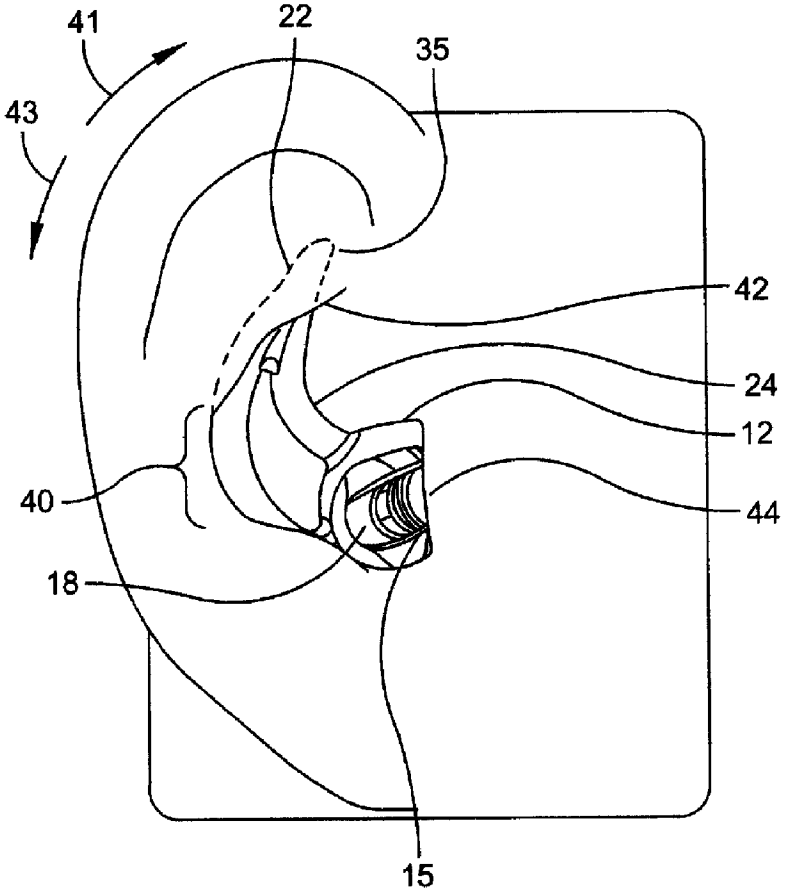
FIG. 4 is a view of a human ear with the earpiece in position.

Referring now to FIG. 4, to place the earpiece in the ear, the body is placed in the ear and pushed gently inward and preferably rotated counter-clockwise as indicated by arrow 43. Pushing the body into the ear causes the body 12 and the outer leg 22 to seat in position underneath the anti-tragus, and causes the outlet section 15 of the body 12 to enter the ear canal. Rotating the body counter-clockwise properly orients in the Z-direction the outer leg 22 for the steps that follow.

The body is then rotated clockwise as indicated by arrow 41 until a condition occurs so that the body cannot be further rotated. The conditions could include: the extremity 35 may contact the base of the helix; leg 24 may contact the base of the helix; or the extremity 25 may become wedged behind the anti-helix in the cymba concha region. Though the positioning and retaining structure provides all three conditions (hereinafter referred to as "modes", not all three conditions will happen for all users, but at least one of the modes will occur for most users. Which condition(s) occur(s) is dependent on the size and geometry of the user's ears.

Providing more than one mode for positioning the earpiece is advantageous because no one positioning mode works well for all ears. Providing more than one mode of positioning makes it more likely that the positioning system will work well over a wide variety of ear sizes and geometries Rotating the body 12 clockwise also causes the extremity and outer leg to engage the cymba concha region and seat beneath the anti-helix. When the body and positioning and retaining structure 20 are in place, positioning and retaining structure and/or body contact the ear of most people in at least two, and in many people more, of several ways: a length 40 the outer leg 22 contacts the anti-helix at the rear of the concha; the extremity 35 of the positioning and retaining structure 20 is underneath the anti-helix 42; portions of the outer leg 22 or body 12 or both are underneath the anti-tragus 44; and the body 12 contacts at the entrance to the ear canal under the tragus. The two or more points of contact hold the earpiece in position, providing greater stability. The distributing of the force, and the compliance of the portions of the body and the outer leg that contact the ear lessens pressure on the ear, providing comfort.

Referring again to View E of FIG. 2 and Views B, C, and D of FIG. 3, the body 12 may have a slightly curved surface 13 that rests against the concha. The periphery of the slightly curved surface may line is a plane, hereinafter referred to as the body plane. In one implementation, the projection of the outer leg 22 of the positioning and retaining structure 20 on the Y-Z plane may be angled relative to the intersection of the body plane 13 and the Y-Z plane, as indicated by line 97 (a centerline of leg 22) and line 99 (parallel to the body plane).

When in position, the body plane 13 is substantially parallel to the X-Y plane. Stated differently, the outer leg 22 is angled slightly outward.

The angling of the positioning and retaining structure 20 has several characteristics. The structure results in a greater likelihood that the extremity will seat underneath the anti-helix despite variations in ear size and geometry. The outward slant conforms better to the ear. The positioning and retaining structure is biased inward, which causes more force to resist movement in an outward direction more than resists movement in an inward direction. These characteristics provide a marked improvement in comfort, fit, and stability over earpieces which have a positioning and retaining structure that is not angled relative to the plane of a surface contacting the concha.

If the angling of the position and retention structure does not cause the extremity to seat behind the anti-helix, the compliance of the extremity in the Z-direction permits the user to press the extremity inward so that it does seat behind the anti-helix.

Providing features that prevent over-rotation of the body results in an orientation that is relatively uniform from user to user, despite differences in ear size and geometry. This is advantageous because proper and uniform orientation of the earpiece results in a proper and uniform orientation of the microphone to the user's mouth.

Figure 5:
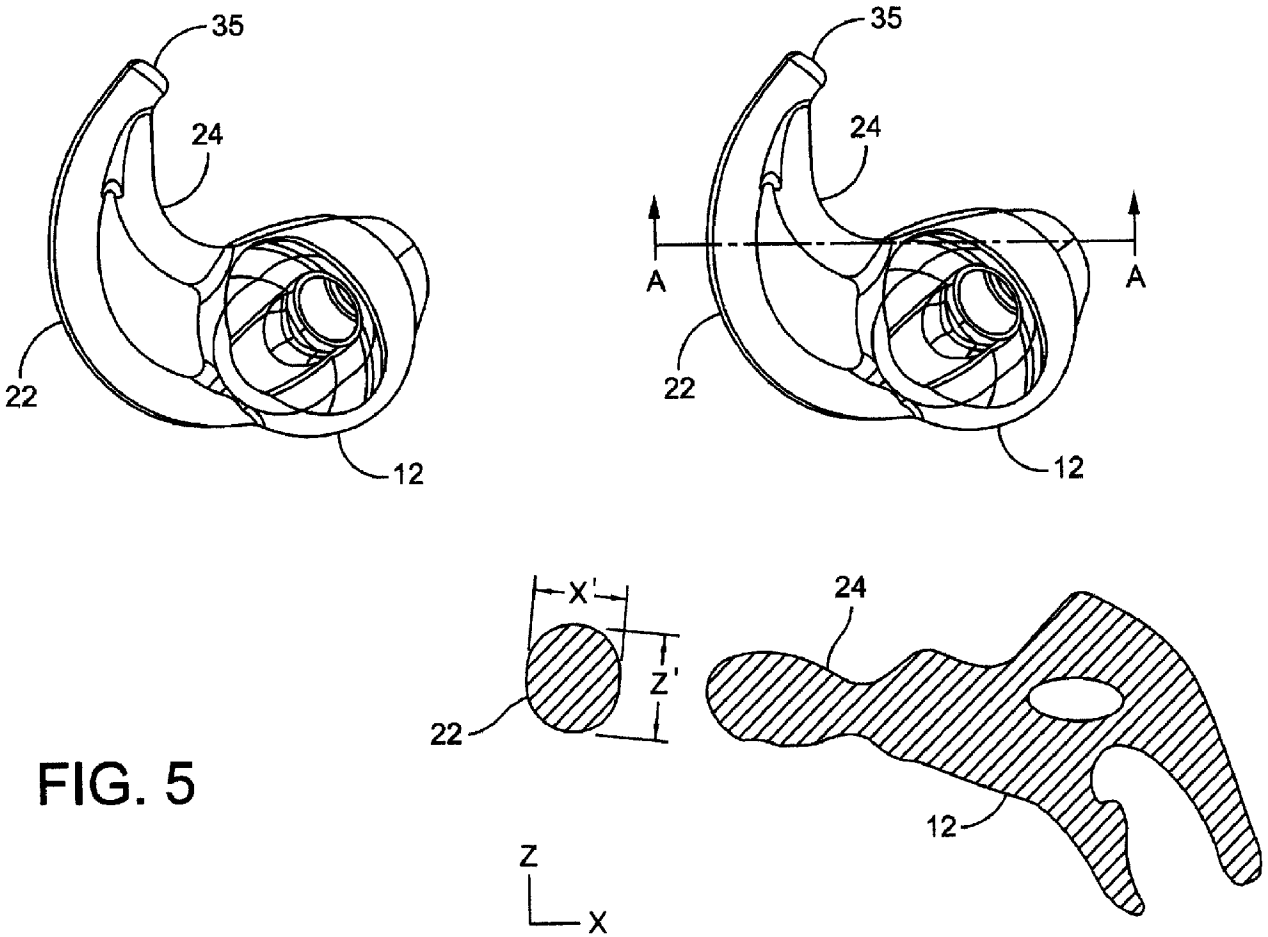
FIG. 5 is an isometric view and a cross-sectional view of a portion of the earpiece.

FIG. 5 shows a cross-section of the body 12 and positioning and retaining structure 20 taken along line A-A. The cross-section is oval or "racetrack" shaped, with the dimension in a direction Z' substantially parallel to the Z-axis 2.0 to 1.0 times the dimension in direction X', substantially parallel to the X-axis, preferably closer to 1.0 than to 2.0, and in one example, 1.15 times the dimension in the X' direction. In some examples, the dimension in the Z' direction may be as low as 0.8 times the dimension in the X' direction. The cross-section permits more surface of the outer leg to contact the anti-helix at the rear of the concha, providing better stability and comfort. Additionally, there are no corners or sharp edges in the part of the leg that contacts the ear, which eliminates a cause of discomfort.

As best shown in Views B and E of FIG. 2, the acoustic driver module is slanted inwardly and forwardly relative to the plane of the body 12. The inward slant shifts the center of gravity relative to an acoustic driver module that is substantially parallel to the positioning and retaining structure 20 or the electronics module 12, or both. The forward slant combined with the inward slant permits more of the acoustic driver module to fit inside the concha of the ear, increasing the stability of the earpiece.

Figure 6:
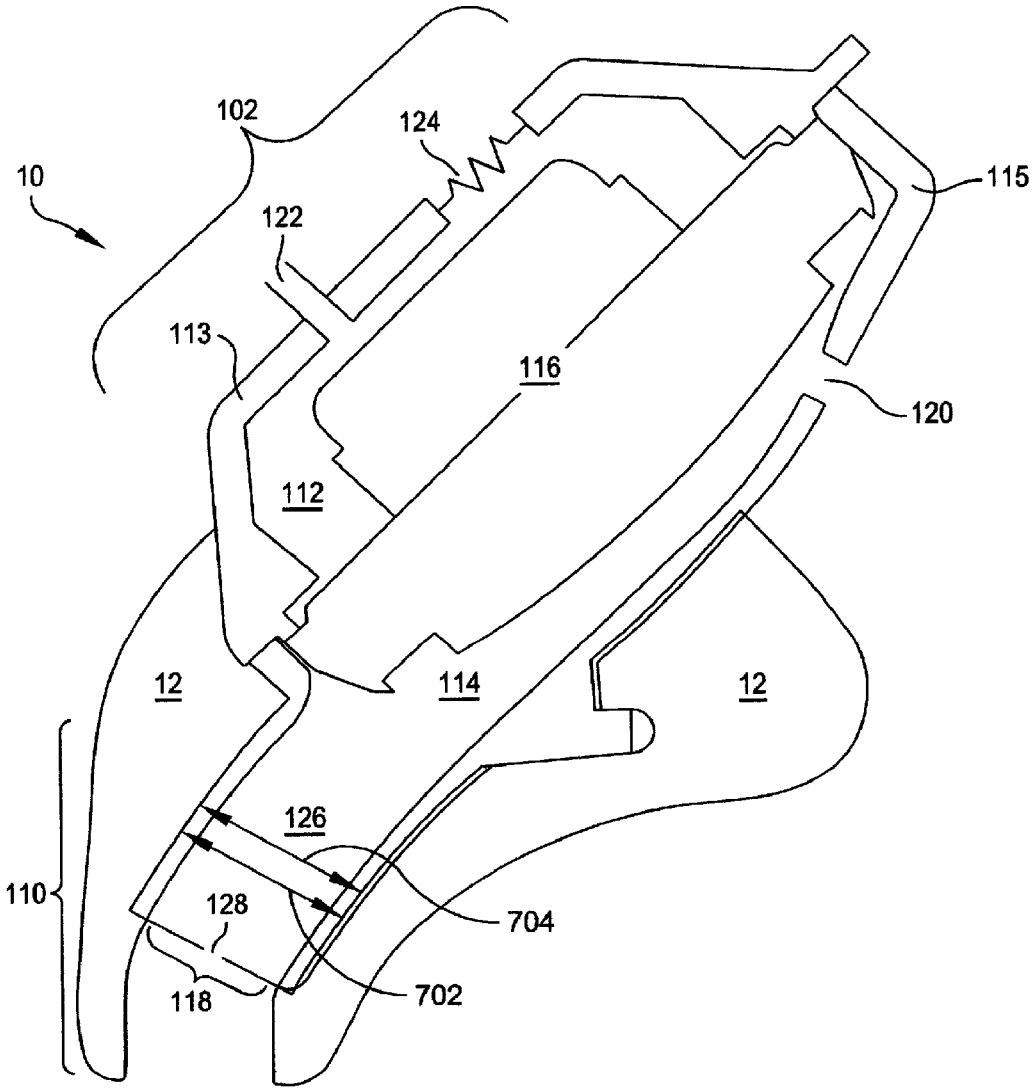
FIG. 6 is a diagrammatic cross-section of a portion of the earpiece.
Figure 7A:
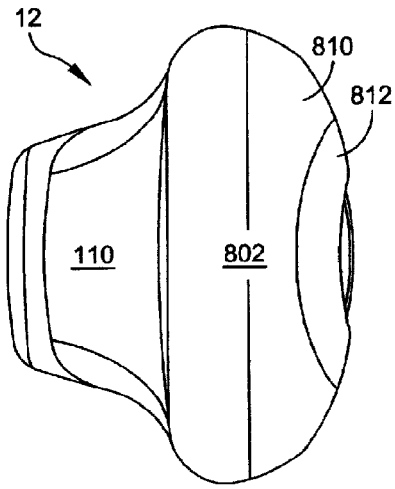
FIGS. 7A-7D show views of a portion of the earpiece.
Figure 7B:
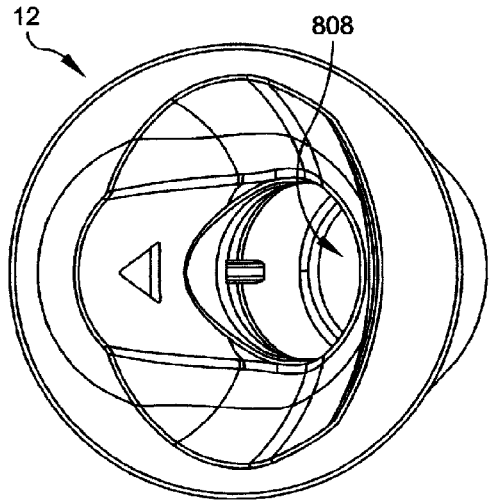
Figure 7C:
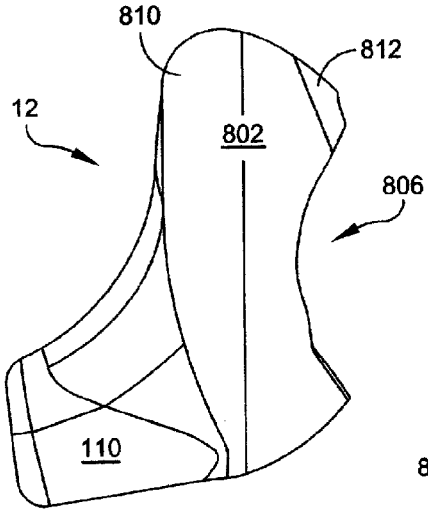
Figure 7D:
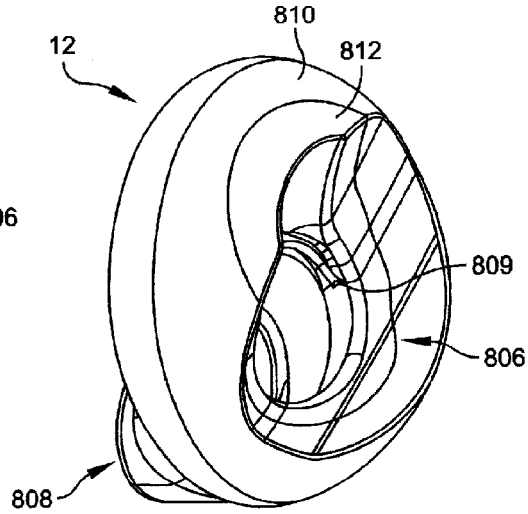

FIG. 6 shows a diagrammatic cross-section of the acoustic driver module 14 and the body 12. A first region 102 of the earpiece 10 includes a rear chamber 112 and a front chamber 114 defined by shells 113 and 115, respectively, on either side of an acoustic driver 116. In some examples, a 15 mm nominal diameter driver is used. A nozzle 126 extends from the front chamber 114 into the entrance to the ear canal, and in some embodiments into the ear canal, through the body 12 and may end at an optional acoustic resistance element 118. In some examples, the optional resistance element 118 is located within nozzle 126, rather than at the end, as illustrated. An acoustic resistance element, if present, dissipates a proportion of acoustic energy that impinges on or passes through it. In some examples, the front chamber 114 includes a pressure equalization (PEQ) hole 120. The PEQ hole 120 serves to relieve air pressure that could be built up within the ear canal 12 and front chamber 114 when the earphone 10 is inserted into the ear. The rear chamber 112 is sealed around the back side of the acoustic driver 116 by the shell 113. In some examples. the rear chamber 112 includes a reactive element, such as a port (also referred to as a mass port) 122, and a resistive element, which may also be formed as a port 124. U.S. Pat. No. 6,831,984 describes the use of parallel reactive and resistive ports in a headphone device. and is incorporated here by reference in its entirety. Although ports are often referred to as reactive or resistive, in practice any port will have both reactive and resistive effects. The term used to describe a given port indicates which effect is dominant. In the example of FIG. 6, the reactive port is defined by spaces in the shell 113. A reactive port like the port 122 is, for example, a tube-shaped opening in what may otherwise be a sealed acoustic chamber, in this case rear chamber 112. A resistive port like the port 124 is, for example, a small opening in the wall of an acoustic chamber covered by a material providing an acoustical resistance, for example, a wire or fabric screen, that allows some air and acoustic energy to pass through the wall of the chamber. The mass port 122 and the reactive port 124 acoustically couple the back cavity 112 with the ambient environment. The mass port 122 and the resistive port 124 are shown schematically. The actual location of the mass port 122 and the resistive port 124 will be shown in figures below and the size will be specified in the specification. Similarly, the actual location and size of the pressure equalization hole 120 will be shown below, and the size specified in the specification.

Each of the body 12, cavities 112 and 114. driver 116, damper 118, hole 120, and ports 122 and 124 have acoustic properties that may affect the performance of the earpiece 10. These properties may be adjusted to achieve a desired frequency response for the earphone. Additional elements. such as active or passive equalization circuitry. may also be used to adjust the frequency response.

To increase low frequency response and sensitivity, a nozzle 126, may extend the front cavity 112 into the ear canal, facilitating the formation of a seal between the body 12 and the ear canal. Sealing the front cavity 114 to the ear canal decreases the low frequency cutoff, as does enclosing the rear of transducer 116 with small cavity 112 including the ports 122 and 124. Together with a lower portion 110 of the cushion, the nozzle 126 provides better seal to the ear canal than earphones that merely rest in the concha, as well as a more consistent coupling to an individual user's ears. The tapered shape and pliability of the cushion allow it to form a seal in ears of a variety of shapes and sizes. In some examples, the rear chamber 112 has a volume of 0.26 $cm^3$, which includes the volume of the driver 116. Excluding the driver, the rear chamber 112 has a volume of 0.05 $cm^3$.

The reactive port 122 resonates with the back chamber volume. In some examples, it has a diameter in the range of about 0.5 mm to 2.0 mm, for example 1.2 mm and a length in the range of about 0.8 mm to 10.0 mm, for example 2.5 mm. In some embodiments. the reactive port is tuned to resonate with the cavity volume around the low frequency cutoff of the earphone. In some embodiments, he low frequency cutoff is around 100 Hz, which can vary by individual, depending on ear geometry. In some examples, the reactive port 122 and the resistive port 124 provide acoustical reactance and acoustical resistance in parallel meaning that they each independently couple the rear chamber 112 to free space. In contrast, reactance and resistance can be provided in series in a single pathway, for example, by placing a resistive element such as a wire mesh screen inside the tube of a reactive port. In some examples, a parallel resistive port is covered by 70×800 Dutch twill wire cloth, for example, that is available from Cleveland Wire of Cleveland, Ohio. Parallel reactive and resistive elements, embodied as a parallel reactive port and resistive port, provides increased low frequency response compared to an embodiment using a series reactive and resistive elements. The parallel resistance does not substantially attenuate the low frequency output while the series resistance does. Using a small rear cavity with parallel ports allows the earphone to have improved low frequency output and a desired balance between low frequency and high frequency output.

The PEQ hole 120 is located so that it will not be blocked when in use. For example. the PEQ hole 120 is not located in the portion of the body 12 that is in direct contact with the ear, but away from the ear in the front chamber 114. The primary purpose of the hole is to avoid an over-pressure condition when the earpiece 10 is inserted into the user's ear. Additionally, the hole can used to provide a fixed amount of leakage that acts in parallel with other leakage that may be present. This helps to standardize response across individuals. In some examples, the PEQ hole 120 has a diameter of about 0.50 mm. Other sizes may be used, depending on such factors as the volume of the front chamber 114 and the desired frequency response of the earphones. Adding the PEQ hole makes a trade off between some loss in low frequency output and more repeatable overall performance.

The body 12 is designed to comfortably couple the acoustic elements of the earphone to the physical structure of the wearer's ear. As shown in FIGS. 7A-7D, the body 12 has an upper portion 802 shaped to make contact with the tragus and anti-tragus of the ear, and a lower portion 110 shaped to enter the ear canal 12, as mentioned above. In some examples, the lower portion 110 is shaped to fit within but not apply significant pressure on the flesh of the ear canal 12. The lower portion 110 is not relied upon to provide retention of the earphone in the ear, which allows it to seal to the ear canal with minimal pressure. A void 806 in the upper portion 802 receives the acoustic elements of the earphone (not shown), with the nozzle 126 (of FIG. 6) extending into a void 808 in the lower portion 110. In some examples, the body 12 is removable from the earpiece 10, examples, the body 12 is formed of materials having different hardnesses, as indicated by regions 810 and 812. The outer region 810 is formed of a soft material. for example, one having a durometer of 16 shore A, which provides good comfort because of its softness. Typical durometer ranges for this section are from 2 shore A to 30 shore A. The inner region 812 is formed from a harder material, for example, one having a durometer of 70 shore A. This section provides the stiffness needed to hold the cushion in place. Typical durometer ranges for this section are from 30 shore A to 90 shore A. In some examples, the inner section 812 includes an O-ring type retaining collar 809 to retain the cushion on the acoustic components. The stiffer inner portion 812 may also extend into the outer section to increase the stiffness of that section. In some examples. variable hardness could be arranged in a single material.

In some examples, both regions of the cushion are formed from silicone. Silicone can be fabricated in both soft and more rigid durometers in a single part. In a double-shot fabrication process, the two sections are created together with a strong bond between them. Silicone has the advantage of maintaining its properties over a wide temperature range, and is known for being successfully used in applications where it remains in contact with human skin. Silicone can also be fabricated in different colors, for example, for identification of different sized cushions, or to allow customization. In some examples, other materials may be used, such as thermoplastic elastomer (TPE). TPE is similar to silicone, and may be less expensive, but is less resistant to heat. A combination of materials may be used, with a soft silicone or TPE outer section 812 and a hard inner section 810 made from a material such as ABS, polycarbonate, or nylon. In some examples, the entire cushion may be fabricated from silicone or TPE having a single hardness, representing a compromise between the softness desired for the outer section 812 and the hardness needed for the inner section 810.

Figure 8:
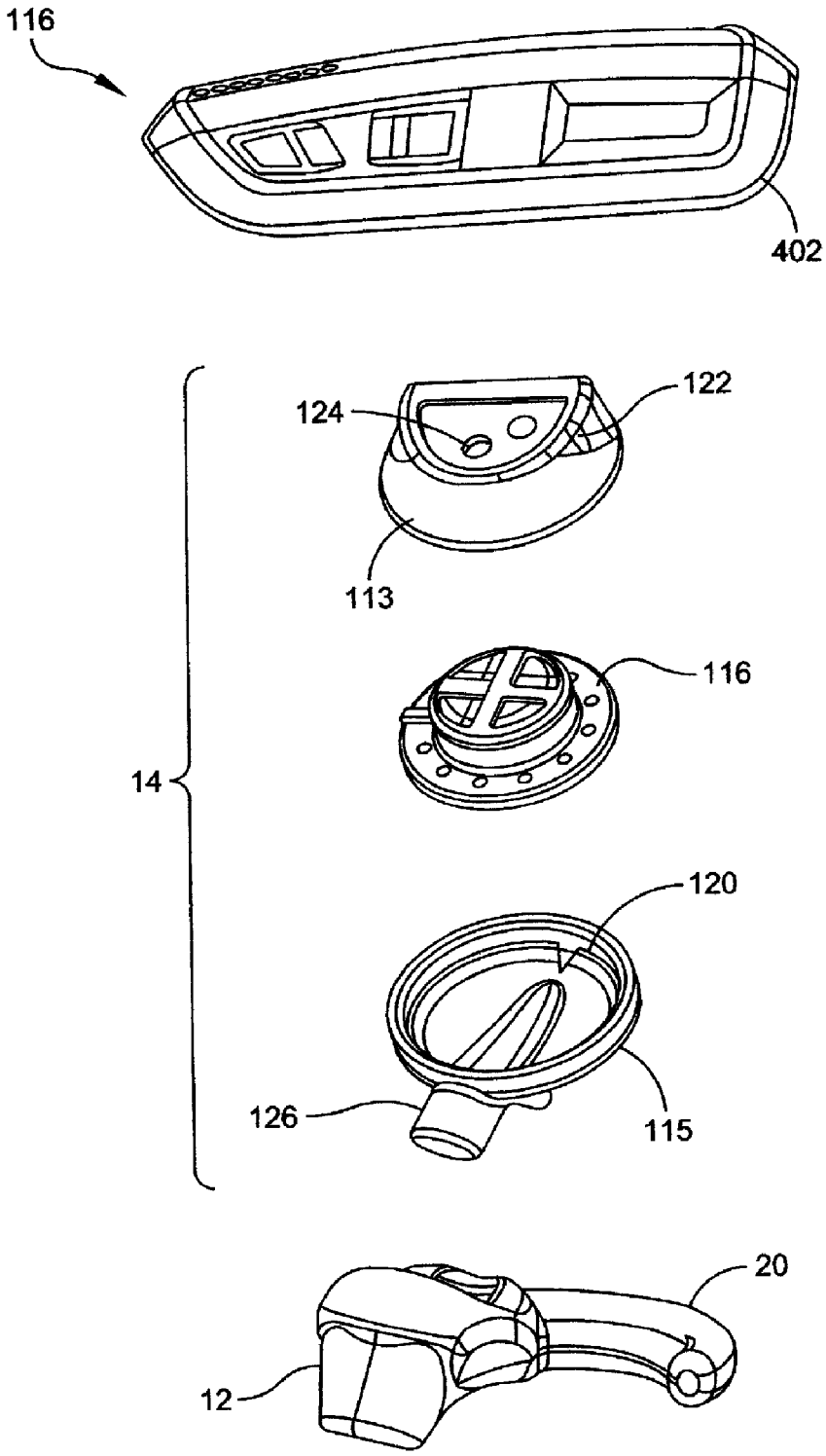
FIG. 8 is a blowup view of the earpiece.

FIG. 8 shows a blowup view of the electronics module 16, the acoustic driver module 14, and the body 12. The electronics module comprises plastic enclosure 402

(which may be multi-piece) that encloses electronic circuitry (not shown) for wirelessly receiving audio signals. Acoustic driver module 14 includes shell 113, acoustic driver 116, and shell 115. The position of the mass port 122 and the reactive port 124 in shell 113 are shown. The position of the PEQ hole 120 on shell 115 is also shown. When the earpiece 10 is assembled, nozzle 126 fits inside the outlet section 15 of the body 12. Referring again to FIG. 6, the outside diameter of the nozzle 126 may be approximately the same as the inside dimension of the outlet section 15, as indicated by arrows 702 and 704.

Figure 9:
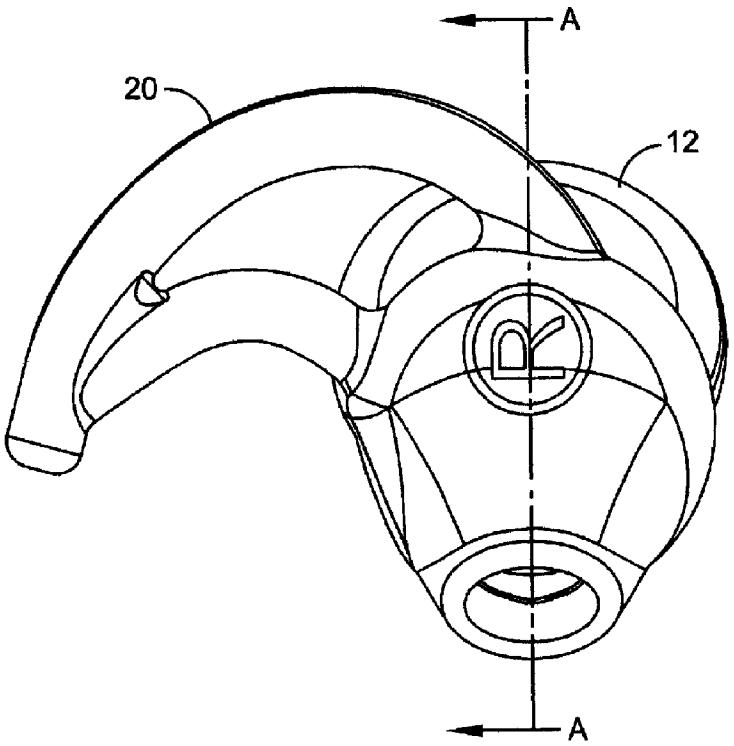
FIG. 9 is an isometric view and a cross-sectional view of a portion of the earpiece.
Figure 9:
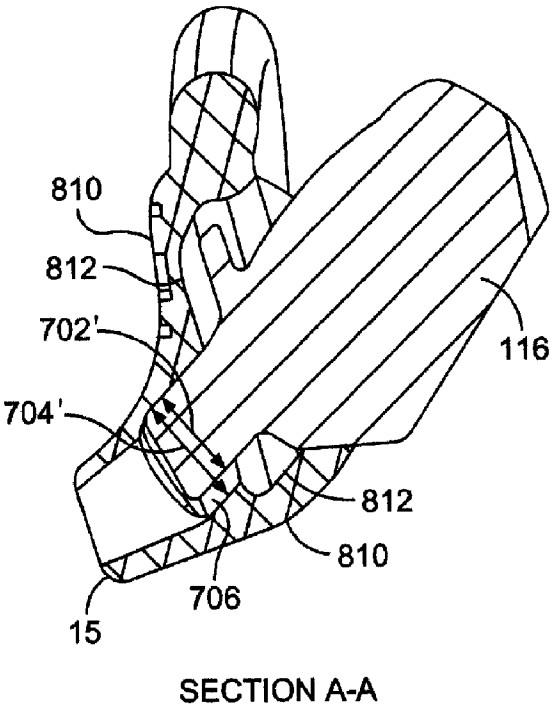

FIG. 9 shows a variation of the assembly of FIG. 6. The implementation of FIG. 9 is the mirror image of the implementation of FIG. 6, to indicate that the earpiece can be configured for either ear. In the implementation of FIG. 9, an outside dimension of the nozzle is smaller than the corresponding inside dimension of the outlet section 15, as indicated by arrows 702' and 704'. The difference in dimensions provides a space 706 between the nozzle and the outlet section 15 of the body 12. The space permits the lower portion of the body 15 to better conform to the ear canal, providing additional comfort and stability. The rigidity of the nozzle results in the ability of the outlet section to conform to the ear canal, without substantially changing the shape or volume of the passage to the ear canal, so the acoustic performance of the earpiece is not appreciably affected by changes in ear size or geometry. The smaller dimension of the nozzle may adversely affect high frequency (e.g. above 3 kHz. However, the circuitry for wirelessly receiving audio signals enclosed in electronics module 16 may be limited to receiving audio signals up to only about 3 kHz, so the adversely affected high frequency performance is not detrimental to the overall performance of the earpiece. One way of allowing an earpiece to play louder is to overdrive the acoustic driver. Overdriving an acoustic driver tends to introduce distortion and adversely affects the bandwidth.

Figure 10:
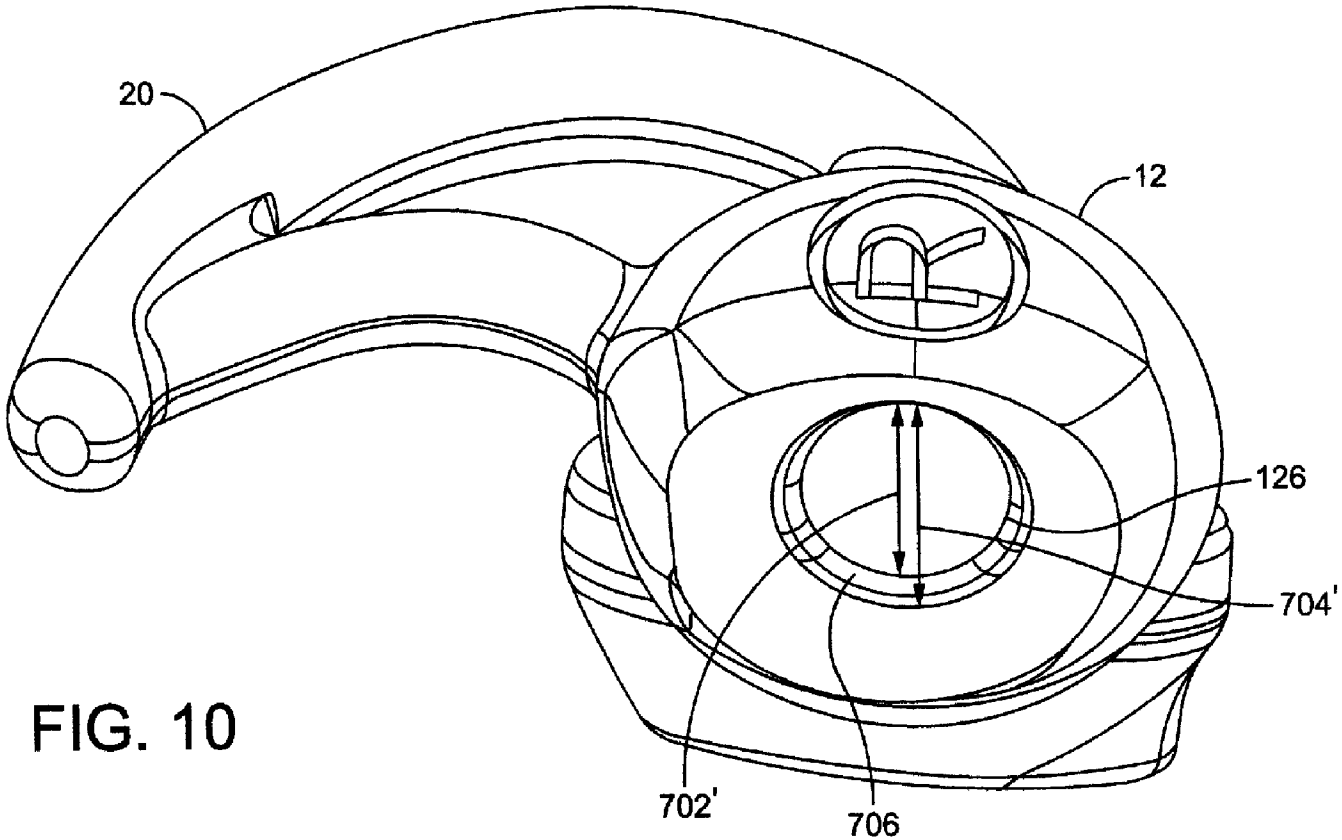
FIG. 10 is an isometric view of the body of the earpiece, with a portion of the body removed.

FIG. 10 shows a body 12 with a portion of the outlet section 15 and the nozzle 126 removed. The inside of the outlet section 15 and the outside of the nozzle 126 are both ovals. The minor axis of the outside of the nozzle, represented by line 702' is 4.05 mm. The minor axis of the inside of the outlet section 15, represented line 704' is 4.80 mm. The width of the space 706 at its widest point is 0.75 mm.

One way of achieving good acoustic performance is to use a larger driver. A larger acoustic driver, for example a 15 mm nominal diameter acoustic driver can play louder with less distortion and with better bandwidth and intelligibility than conventional smaller acoustic drivers. However the use of larger acoustic drivers has some disadvantages. Acoustic drivers that have a diameter (nominal diameter plus housing) of greater than 11 mm do not fit in the conchas of many people. If the acoustic driver is positioned outside the concha, the center of mass may be well outside the ear so that the earpiece is unstable and tends to fall out of the ear. This problem is made worse by the presence of the electronics module 12, which may be heavy relative to other components of the earpiece, and which moves the center of mass even further away from the side of the head.

As best shown in Views B and E of FIG. 2, the acoustic driver module is slanted inwardly and forwardly relative to the plane of the positioning and retention structure 20 and the plane of the electronics module 12. The inward slant shifts the center of gravity relative to an acoustic driver module that is substantially parallel to the positioning and retention structure 20 or the electronics module 12, or both. The forward slant combined with the inward slant permits more of the acoustic driver module to fit inside the concha of the ear, increasing the stability of the earpiece.

What is claimed is:

1. An earpiece comprising:

an electronics module including communication electronics coupled to an acoustic driver module housing an acoustic driver; and an ear interface structure coupled to the acoustic driver module, comprising:

a body shaped to fit in at least a part of the concha of a user's ear, the body having an outlet section shaped to fit at least partly into the ear canal of the user's ear, and a passageway shaped to conduct sound waves from the acoustic driver at least the outlet section to the ear canal of the user; and a positioning and retaining structure extending from the body and ending in an extremity, the positioning and retaining structure being curved to generally follow the curve of the anti-helix of the user's ear at the rear of the concha;

wherein, when the ear interface structure is seated in a user's ear, the electronics module is held outward from the user's head by the acoustic driver module, and the positioning and retaining structure is seated beneath the antihelix of the user's ear.

2. The earpiece of claim 1, wherein when the ear interface structure is seated in a user's ear, the positioning and retaining structure prevents the earpiece from tipping away from the user's head.

3. The earpiece of claim 1, wherein the extremity is positioned near the intersection of the antihelix and the helix of the user's ear when the earpiece is worn.

4. The earpiece of claim 1, wherein the ear interface structure is removable.

5. The earpiece of claim 4, further comprising a second ear interface structure interchangeable with the first ear interface structure.

6. The earpiece of claim 1, wherein the positioning and retaining structure comprises a first leg following the curve of the anti-helix and a second leg supporting the first leg.

7. The earpiece of claim 1, wherein the electronics module includes a wireless transceiver and a microphone.

8. The earpiece of claim 7, wherein the microphone is in an end of the electronics module that extends towards the user's mouth when the ear interface structure is seated in the user's ear.

9. An ear interface for use with an earpiece comprising an electronics module including communication electronics coupled to an acoustic driver module housing an acoustic driver, the ear interface comprising:

a mating surface for coupling to the acoustic driver module;

a body shaped to fit in at least a part of the concha of a user's ear, the body having an outlet section shaped to fit at least partly into the ear canal of the user's ear, and a passageway shaped to conduct sound waves from the acoustic driver through at least the outlet section to the ear canal of the user; and a positioning and retaining structure extending from the body and ending in an extremity, the positioning and retaining structure being curved to generally follow the curve of the anti-helix of the user's ear at the rear of the concha;

wherein, when the ear interface structure is seated in a user's ear, it retains the electronics module to the ear such that the electronics module is held outward from the user's head by the acoustic driver module, and the positioning and retaining structure is seated beneath the antihelix of the user's ear.

10. The earpiece of claim 9, wherein the ear interface is removable from the acoustic driver module.

11. The earpiece of claim 10, further comprising a second ear interface comprising the same components as the first ear interface but of a different overall dimension.

* * * * *